US008636600B2

(12) United States Patent
Howard

(10) Patent No.: US 8,636,600 B2
(45) Date of Patent: Jan. 28, 2014

(54) ROLLER COASTER VEHICLE

(75) Inventor: Derek Howard, Burbank, CA (US)

(73) Assignee: Disney Enterprises, Inc., Burbank, CA (US)

( * ) Notice: Subject to any disclaimer, the term of this patent is extended or adjusted under 35 U.S.C. 154(b) by 315 days.

(21) Appl. No.: 12/914,544

(22) Filed: Oct. 28, 2010

(65) Prior Publication Data

US 2011/0319179 A1 Dec. 29, 2011

Related U.S. Application Data

(63) Continuation-in-part of application No. 12/822,721, filed on Jun. 24, 2010, now Pat. No. 8,360,893.

(51) Int. Cl.
*A63G 1/08* (2006.01)
*A63G 1/00* (2006.01)

(52) U.S. Cl.
USPC ..... 472/43; 472/59; 104/77

(58) Field of Classification Search
USPC ..... 472/30, 45, 47, 59, 60, 130; 104/53, 57, 104/77, 78, 81; 434/29, 55
See application file for complete search history.

(56) References Cited

U.S. PATENT DOCUMENTS

| | | | | |
|---|---|---|---|---|
| 4,251,140 | A * | 2/1981 | Fogerty, Jr. | 352/132 |
| 5,623,878 | A | 4/1997 | Baxter | |
| 6,095,926 | A * | 8/2000 | Hettema et al. | 472/59 |
| 6,158,354 | A | 12/2000 | Eiraku | |
| 6,269,749 | B1 | 8/2001 | Hogg | |
| 6,884,177 | B2 * | 4/2005 | Zambelli et al. | 472/47 |
| 7,094,157 | B2 * | 8/2006 | Fromyer et al. | 472/59 |
| 7,610,859 | B1 | 11/2009 | Dietrich | |
| 8,066,576 | B2 | 11/2011 | Threlkel | |
| 2002/0068641 | A1 | 6/2002 | Dicicco | |
| 2008/0173208 | A1 | 7/2008 | Heinrich | |

FOREIGN PATENT DOCUMENTS

| | | | |
|---|---|---|---|
| CH | 658431 | A | 11/1986 |
| DE | 8717429 | | 12/1988 |
| DE | 20021936 | U1 | 5/2002 |
| GB | 226914 | A | 1/1925 |
| NL | 9401636 | A | 4/1996 |
| WO | 03082421 | A1 | 10/2003 |
| WO | 2007055572 | | 5/2007 |
| WO | 2007139508 | | 12/2007 |

OTHER PUBLICATIONS

Search Report from Netherlands Application No. 1030415 dated Dec. 5, 2006.
Extended Search Report, EP 11170801, Oct. 18, 2011, 3 pages, Munich, Germany.
Roller Coaster Database, Orphan Rocker—Scenic World (Katoomba, New South Wales, Australia), Internet Publication by Duane Marden, available at http://rcd.com/1870.htm (last accessed on Dec. 10, 2012), Publication date 2002, 22 pages.

* cited by examiner

*Primary Examiner* — Kien Nguyen
(74) *Attorney, Agent, or Firm* — Ference & Associates LLC

(57) ABSTRACT

Ride systems providing guest compartment(s) with a roll degree of freedom through radial mount(s) are described. The guest compartment of the vehicles is attached to a track via a chassis. The guest compartment and the chassis are configured such that the guest compartment has a roll degree of freedom relative to the chassis.

20 Claims, 6 Drawing Sheets

ROLLER COASTER VEHICLE

CROSS REFERENCE TO RELATED APPLICATION

This application is a continuation in part of U.S. patent application Ser. No. 12/822,721, entitled "Roller Coaster Vehicle", filed on Jun. 24, 2010 now U.S. Pat. No. 8,360,893, the contents of which are incorporated by reference as if fully set forth herein.

FIELD OF THE INVENTION

The subject matter presented herein generally relates to vehicles for use in connection with rides, such as amusement park rides or theme park rides.

BACKGROUND

Parks, such as theme parks or amusement parks, are popular worldwide. Rides attract and entertain substantial numbers of visitors to the parks. Some guests particularly enjoy rides in which the riders travel along a track, for example as with roller coaster rides. There are different types of roller coasters; each having different components that can be used to categorize the different types in many ways. In each, one or more vehicles (cars) run along a track structure that is supported in some way (for example by a lattice similar to a beam framework that supports a building).

Roller coasters differ in how the vehicle(s) and components thereof interface with the track and/or how the guest compartment of the vehicle is mounted relative to the track. In each, the design is configured to keep the vehicle securely anchored to the track. In traditional roller coasters, the guest compartment of the vehicle is rigidly mounted to a chassis (that is, not having a degree of freedom there between) that follows the track layout below the vehicle's guest compartment. For example, many coasters mimic trains, having a set of vehicles that ride above a track. This provides a traditional and well known/familiar experience for the riders. Such a configuration is relatively predictable to the rider based on simply looking at the track in front of the vehicle. In some designs, however, the track may run above the vehicle (attach at the top of the vehicle), with the guest compartment hanging below, as in a ski lift. For example, in an inverted roller coaster, the hanging train is attached to the track running above.

Certain roller coaster designs have introduced a degree of freedom between the guest compartment and the chassis attached to the track, such that the guest compartment is not rigidly attached to the chassis. For example, a spinning roller coaster is a roller coaster with vehicles that rotate on a vertical axis relative to the chassis (and relative to the track). In suspension roller coasters, the hanging train of vehicles swing or roll about pivoted joints, with the guest compartments placed below the track, adding an additional side-to-side motion.

SUMMARY OF THE INVENTION

Embodiments of the invention broadly contemplate a ride system providing guest compartment(s) with a roll degree of freedom through a radial mount. A guest compartment is attached to a track via a chassis. The chassis is attached to the track via a portion configured to securely attach to the track, and attached to the guest compartment via a radial mount portion, which thus imparts a roll degree of freedom relative to the chassis.

In summary, one aspect provides a ride vehicle comprising: a guest compartment having an attachment portion; and a chassis configured to travel along a track, the chassis having a radial mount portion and a portion configured to securely attach to the track; wherein the attachment portion of the guest compartment and the radial mount portion of the chassis are configured to connect the guest compartment and the chassis such that a roll degree of freedom is imparted to the guest compartment relative to the chassis.

Another aspect provides a ride system comprising: a plurality of vehicles; wherein one or more of the plurality of vehicles comprises: a guest compartment having an attachment portion; and a chassis configured to travel along a track, the chassis having a radial mount portion and a portion configured to securely attach to the track; wherein the attachment portion of the guest compartment and the radial mount portion of the chassis are configured to connect the guest compartment and the chassis such that a roll degree of freedom is imparted to the guest compartment relative to the chassis.

A further aspect provides a ride system comprising: a plurality of vehicles; and a plurality of tracks; wherein one or more of the plurality of vehicles are configured to ride on separate tracks of the plurality of tracks; wherein one or more of the plurality of vehicles comprises: a guest compartment having an attachment portion; and a chassis configured to travel along a track of the plurality of tracks, the chassis having a radial mount portion and a portion configured to securely attach to the track of the plurality of tracks; wherein the attachment portion of the guest compartment and the radial mount portion of the chassis are configured to connect the guest compartment and the chassis such that a roll degree of freedom is imparted to the guest compartment relative to the chassis.

The foregoing is a summary. For a better understanding of example embodiments, together with other and further features and advantages thereof, reference is made to the following description, taken in conjunction with the accompanying drawings, and the scope of the invention will be pointed out in the appended claims.

DETAILED DESCRIPTION

Figure 1:
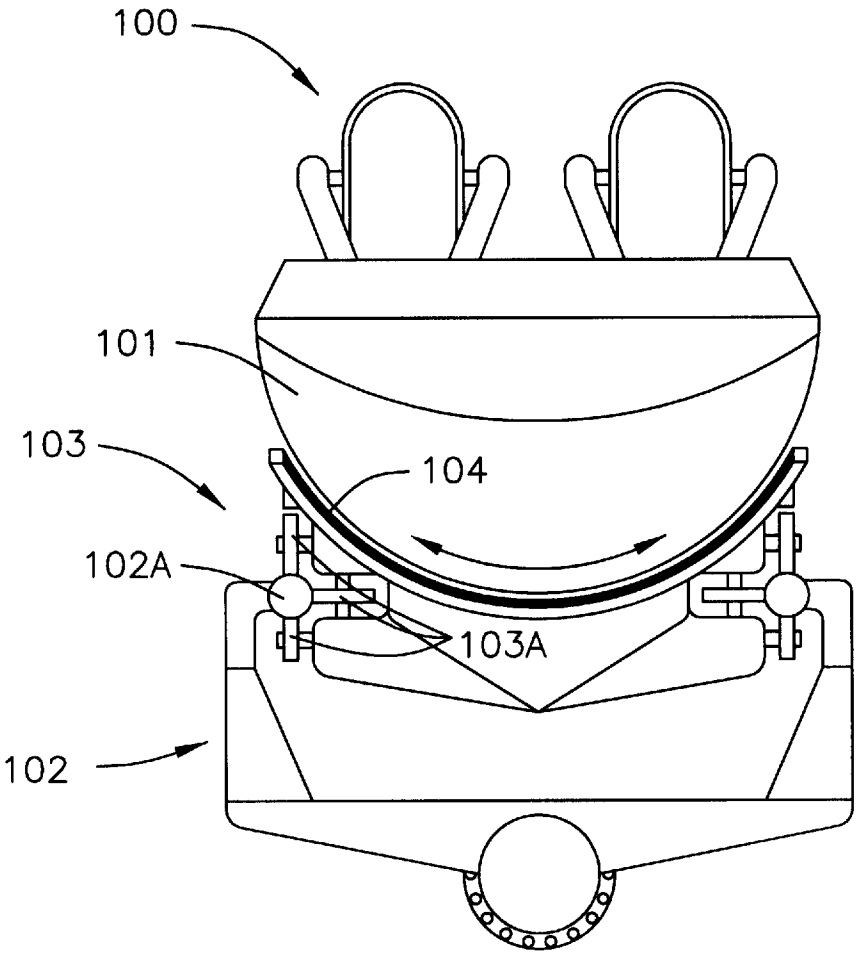
FIG. 1 illustrates a front view of an example vehicle with a roll degree of freedom.

Components of the embodiments, as generally described and illustrated in the figures herein, may be arranged and designed in a wide variety of different configurations in addition to the described example embodiments. Thus, the following more detailed description of example embodiments, as represented in the figures, is not intended to limit the scope of the invention, as claimed, but is merely representative of example embodiments.

Reference throughout this specification to embodiment(s) means that a particular feature, structure, or characteristic described in connection with the embodiment is included in at least one embodiment. Thus, appearances of the phrases "certain embodiments" or "example embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that various embodiments can be practiced without one or more of the specific details, or with other methods, components, materials, et cetera. In other instances, well-known structures, materials, or operations are not shown or described in detail to avoid obfuscation.

Traditional roller coaster vehicles/cars are configured such that the guest compartment is rigidly mounted to a chassis that follows a custom track layout. While this provides a traditional and well-known experience that is relatively predictable to the guest, the lateral forces resultant from such rigid mounting can be uncomfortable, especially when over-the-shoulder restraints are used to secure guests within the guest compartment.

Moreover, while certain roller coaster configurations have employed a degree of freedom between the guest compartment and the chassis attaching the vehicle to the track, these configurations fall short in certain respects. For example, with spinning coasters, the movement of the vehicles is restricted in as much as the vehicle is not permitted to roll. Thus lateral accelerations are not controllable. In roller coaster configurations that permit roll, such as in a suspension roller coaster, the track is placed above the guest compartment and the attachment or pivot point for connection between the guest compartment and the chassis is placed relatively distant from the center of gravity of the guest compartment.

Accordingly, embodiments are directed to systems and methods providing amusement park rides having variability of guest experience via a guest compartment configured with a roll degree of freedom relative to a connection (chassis) with the track. Co-pending and commonly assigned U.S. patent application Ser. No. 12/822,721 describes embodiments having a pivoting connection(s). Similarly, embodiments described herein impart roll degree of freedom by virtue of radial mount(s).

A roll degree of freedom is defined herein as a degree of freedom between a guest compartment and a chassis attaching to the track, permitting rolling motion for the guest compartment relative to the chassis about an axis running parallel to the track. The roll degree of freedom therefore imparts (perpendicular) roll to the guest compartment about the axis running parallel to the track. The guest compartment is attached to a chassis via a radial mount, and the chassis is in turn attached to the track. The radial mount configuration can take a variety of forms, including but not limited to one or more radial mounts positioned at the front and/or rear of each vehicle's guest compartment, with or without additional components (for example, damping and/or actuating components), one or more radial mounts positioned proximate to but below the center of gravity for the vehicle, and/or one or more radial mounts positioned above the center of gravity for the vehicle, as for a suspension coaster.

Embodiments provide a roll degree of freedom to the guest compartment to control (for example, filter) lateral accelerations on the guest compartment. The controlling of lateral accelerations is achieved by permitting the guest compartment to roll, at least within a limited range, to compensate for, or add to, forces placed on the guest compartment throughout its travel along the track. Certain embodiments provide controlled rolling motions to the guest compartment for modified and/or planned rolling motions, as suitable for allowing a reduced or an increased range of roll. Such controlled rolling motions are useful in contexts such as with a theme ride having custom scenery for which planned orientation changes for the guest compartment are desirable to provide varying views of, and proximity to, the custom scenery.

Rolling motions can be varied by appropriate configuration of the radial mount(s), the guest compartment, the track, and combinations thereof. By way of example, controlled rolling motions can be achieve passively, as by permitting the guest compartment to roll within a limited range by virtue of an additional element (such as a limiting arrangement) and track design that, due to the force of gravity and inertia of the guest compartment, imparts varying forces to the guest compartment as it travels. Thus passive control of rolling motions can be achieved for example via use of limiting arrangement(s) and/or damping arrangement(s), as further described herein. Moreover controlled rolling motions can be achieved actively, as for example by imparting motion to the guest compartment via a motor configured to impart roll to the guest compartment throughout the guest compartment's travel along the track. Active control of rolling motions can be achieved via use of actuator(s), as described further herein.

As will be apparent to those having ordinary skill in the art, the various components described herein can be provided as separate elements or integrated with other described elements, depending on the particular use context contemplated, materials and design chosen, and the like, so long as the desired functionality is achieved. Non-limiting examples of suitable configurations are described throughout.

Referring to FIG. 1, an example embodiment of a roller coaster vehicle 100 is illustrated. A front view of the vehicle 100 is illustrated. The vehicle 100 is configured to ride above a track 102. The vehicle 100 includes a guest compartment 101 attached to a chassis 103. The chassis 103 includes three wheels 103*a* on each side of the chassis 103 that are configured above, below and inside a track tube 102*a* for keeping the guest compartment 101 fixed to the track 102. The positioning of the wheels 103*a* is suitable to permit attachment or coupling such that the vehicle 100 travels along the track 102 by riding atop the track tube 102*a*, and the chassis 103 is securely coupled to the track tube 102*a*. The configuration shown in FIG. 1 constrains movement such that the chassis 103 is not permitted to lift off of the track 102 or move laterally. Other configurations for the chassis 103 are possible, including use of other components and/or different positioning of those components, so long as a secure, constrained coupling that permits rolling and smooth interface between chassis 103 and track 102 is obtained.

Embodiments are configured to provide a guest compartment, such as guest compartment 101, with a roll degree of freedom relative to a chassis 103. Again, the roll degree of freedom is about an axis that runs parallel to the track 102 such that the guest compartment 101 rolls as indicated by the double arrow in FIG. 1 (similar double arrows are utilized in other front view FIGs. throughout). As illustrated in FIG. 1, this roll degree of freedom can be imparted by providing a radial mount 104. The radial mount 104 provides an interface between the chassis 103 to the guest compartment 101, allowing rotation (roll) of the guest compartment 101. The example radial mount 104 is positioned proximate to but below the center of gravity of the vehicle 100 such that appropriately limited rolling of the guest compartment 101 is achieved without risking capsize of the guest compartment 101. Further descriptions of means for limitation of roll are provided herein.

Figure 2:
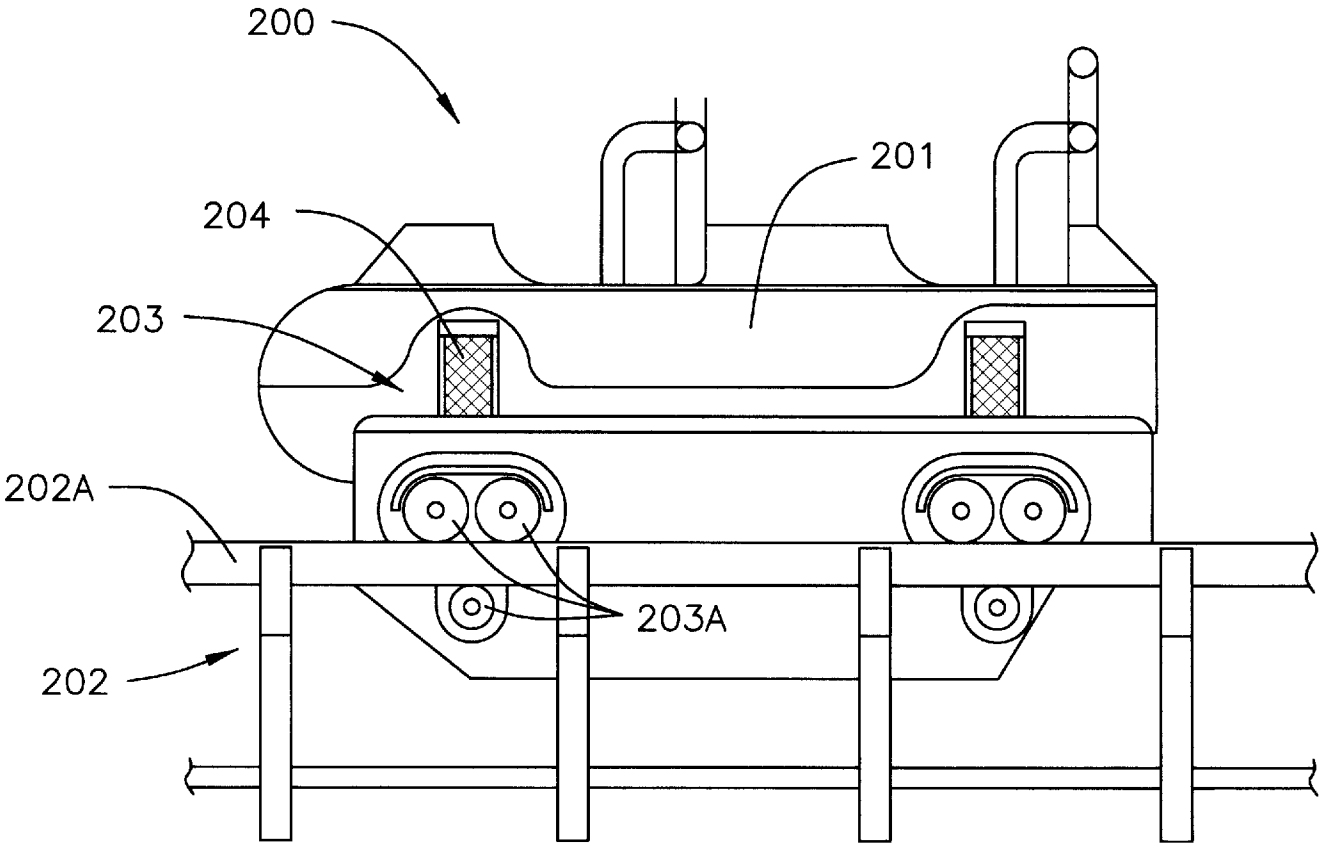
FIG. 2 illustrates a side view of an example vehicle with a roll degree of freedom.

Referring to FIG. 2, a side view of an example vehicle 200 is illustrated. The vehicle 200 includes a guest compartment 201 that provides seating for a plurality of guests (not shown). The guest compartment 201 interfaces with chassis 203 via a radial mount 204. Depending on the configuration of the guest compartment 201 (for example, the size of the guest compartment), more than one radial mount 204 can be utilized. The chassis 203 again interfaces with the track 202 via a plurality of wheels 203*a*, such that chassis is securely attached to the track tube 202*a*.

Figure 3:
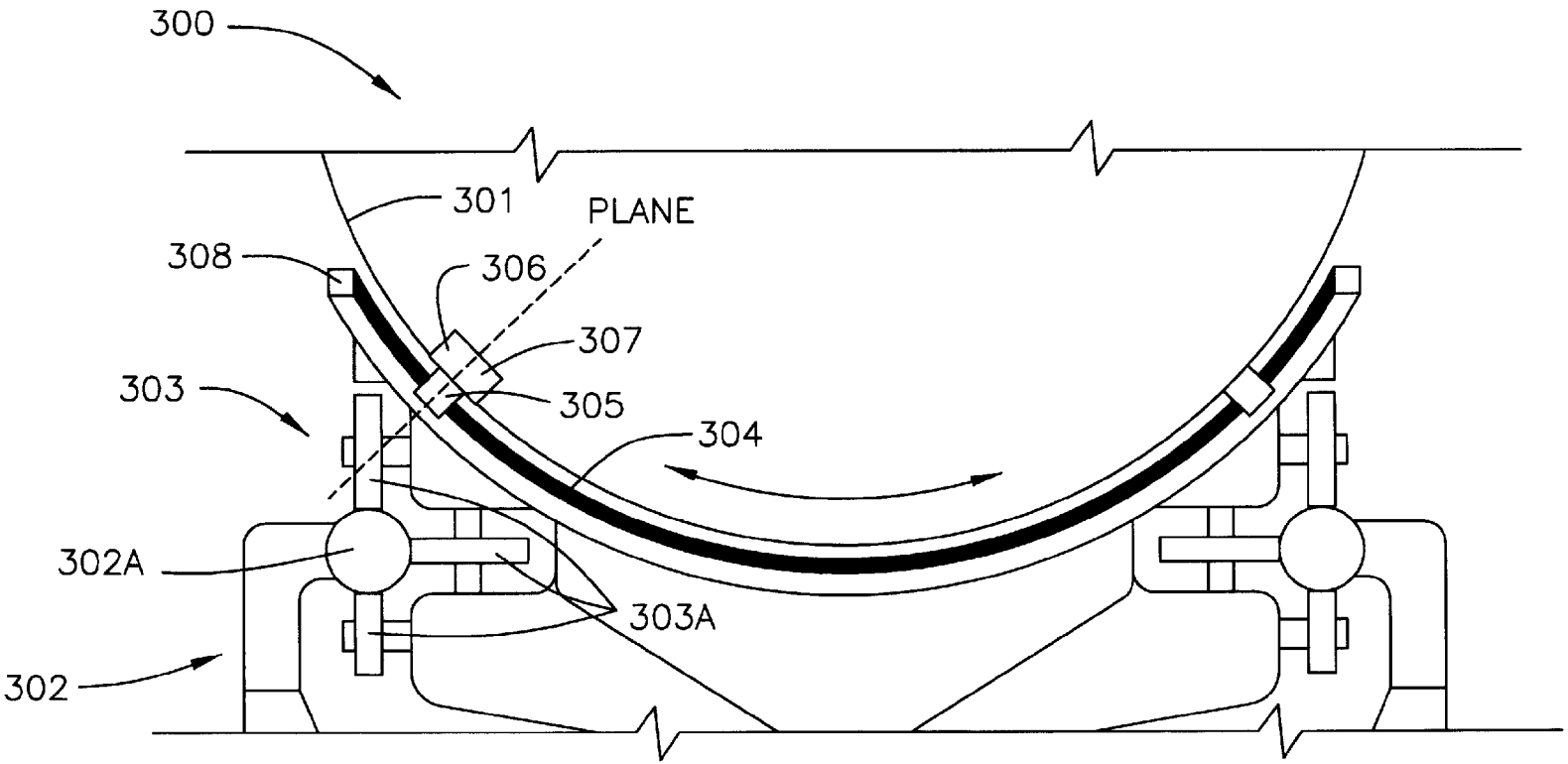
FIG. 3 illustrates a front view of example interfaces between a guest compartment, a chassis, and a track.

Referring to FIG. 3, the interface created via the radial mount 304 likewise can take a variety of forms. The radial mount 304 provides a rolling interface with the chassis 303 via an attachment 305. The attachment 305 (described in further detail with reference to FIG. 4) provides a smooth, secure interface between the guest compartment 301 and the chassis 303. This interface between the guest compartment 301 and chassis 303 is provided via attachment 305 to the radial mount 304, which secures the guest compartment 301 to the chassis 303. Thus, as illustrated in FIG. 3, the radial mount 304 may be considered a portion of the chassis 303. The radial mount can be incorporated elsewhere, as for example included as part of the guest compartment. Thus, the components can be configured in a variety of ways, so long as an attachment portion (e.g. of the guest compartment) and a radial mount portion (e.g. of the chassis) connect the guest compartment and the chassis such that a roll degree of freedom is imparted to the guest compartment relative to the chassis.

The amount of roll permitted as the vehicle 300 travels along the track 302 (again, as for example by rolling along a track tube 302*a* via wheel assembly 303*a* of the chassis 303) can be controlled in a variety of ways. For example, to provide an absolute limit to the amount of roll permitted, the chassis 303 can be configured with a stop or limiting arrangement 308 such that attachment 305 abuts the limiting arrangement 308 on a maximum permissible roll. It is equally acceptable to configure the radial mount portion 304 and/or the guest compartment 301 with a limiting arrangement integral thereto. For example, a limiting arrangement can also exist on an articulating guest cabin/compartment portion of the ride vehicle.

In addition, embodiments can be configured with additional components 306, 307 for achieving active and passive rolling. For example, additional component 306 can include a damping arrangement that assists in controlling passive rolling (for example, due to gravity and inertia as guest compartment 301 travels along the track 302). A damping arrangement 306 can remove energy (as by friction/resistance) as is known such that the amount and/or speed of rolling is reduced and thus controlled. Examples of suitable damping arrangements 306 are know to include but are not necessarily limited to rotation dampers such as hydraulic cylinder(s) or eddy current assemblies.

As another example, an additional component 307 can include an actuator that actively rolls the guest compartment 301. Examples of devices suitable for use as actuators 307 include but are not limited to hydraulic, electronic or pneumatic cylinder(s), and/or a linear electric motor assembly such as a linear induction motor (LIM) assembly or a linear synchronous motor (LSM) assembly. It should be noted that like the other components of the embodiments described herein, the additional components 306, 307 can be configured in a wide variety of ways, for example by integrating them with the attachment 305.

Figure 4:
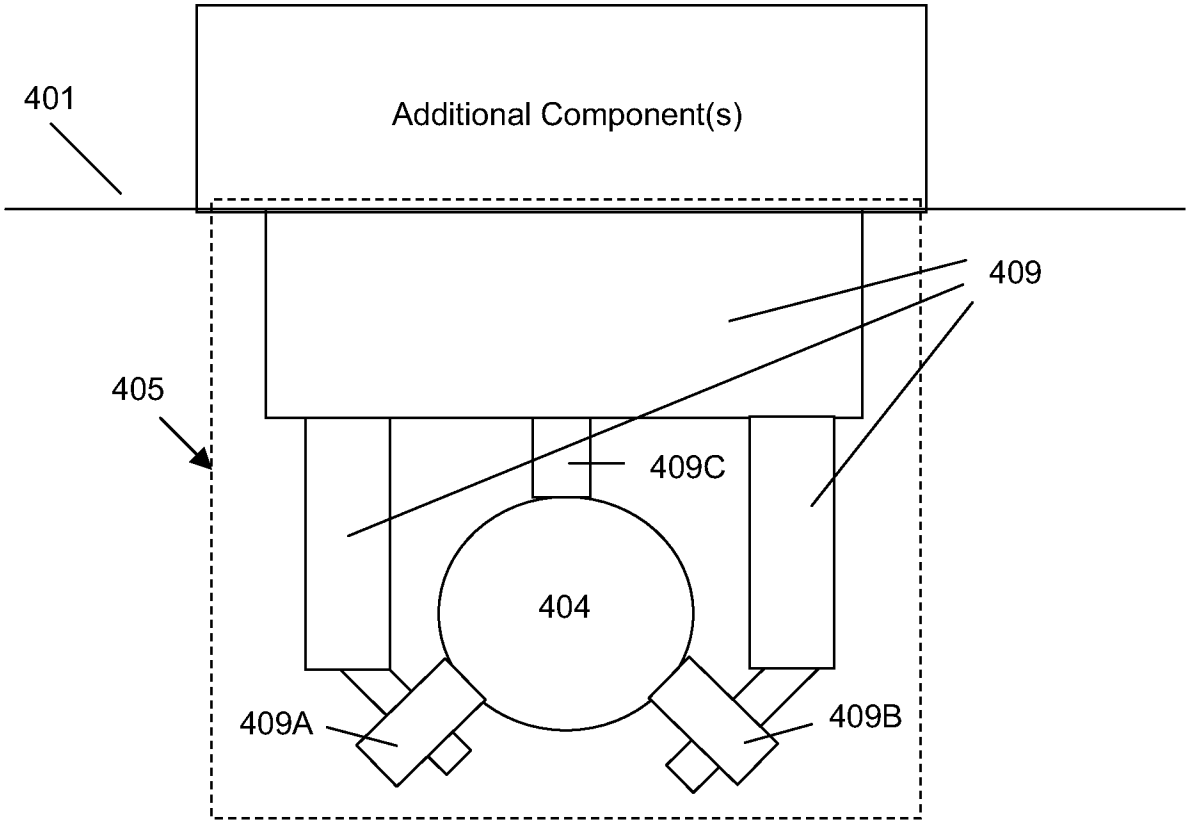
FIG. 4 illustrates a front cross section view of an example interface between an attachment of a guest compartment and a radial mount of a chassis.

Referring to FIG. 4, an example attachment 405 is illustrated. The view illustrated in FIG. 4 is a cross section along the plane of FIG. 3. The attachment 405 provides a secure and smooth interface between the radial mount 404 and the guest compartment 401. The attachment 405 can be configured in a variety of ways so long as secure connection that permits rolling between guest compartment 401 and radial mount 404 is achieved. An example of such a configuration is described herein.

The attachment 405 includes a plurality of structural components 409 that terminate in a plurality of wheels 409*a*, 409*b*, 409*c* that permit rolling about the radial mount 404. Thus, the interface between the attachment 405 and the radial mount 404 can mimic that of the interface between the chassis 303 and the track tube 302*a*, respectively. This permits the guest compartment 401 to roll along the radial mount 404 (with appropriate limits and/or with passive and/or active control, as described herein) while the guest compartment 401 travels along the track.

Although example embodiments have been described referring to a single vehicle with a guest compartment that rides atop a track, this is by no means limiting. Embodiments may be implemented as multi-vehicle and/or multi-track systems; such as for use in "train" type rides and/or "racer" type rides (where vehicles of each ride system or trains of vehicles of each ride system travel substantially along side one another on different tracks). Moreover, the vehicle(s) can be configured such that they ride below the track, as in a suspension coaster.

Figure 5:
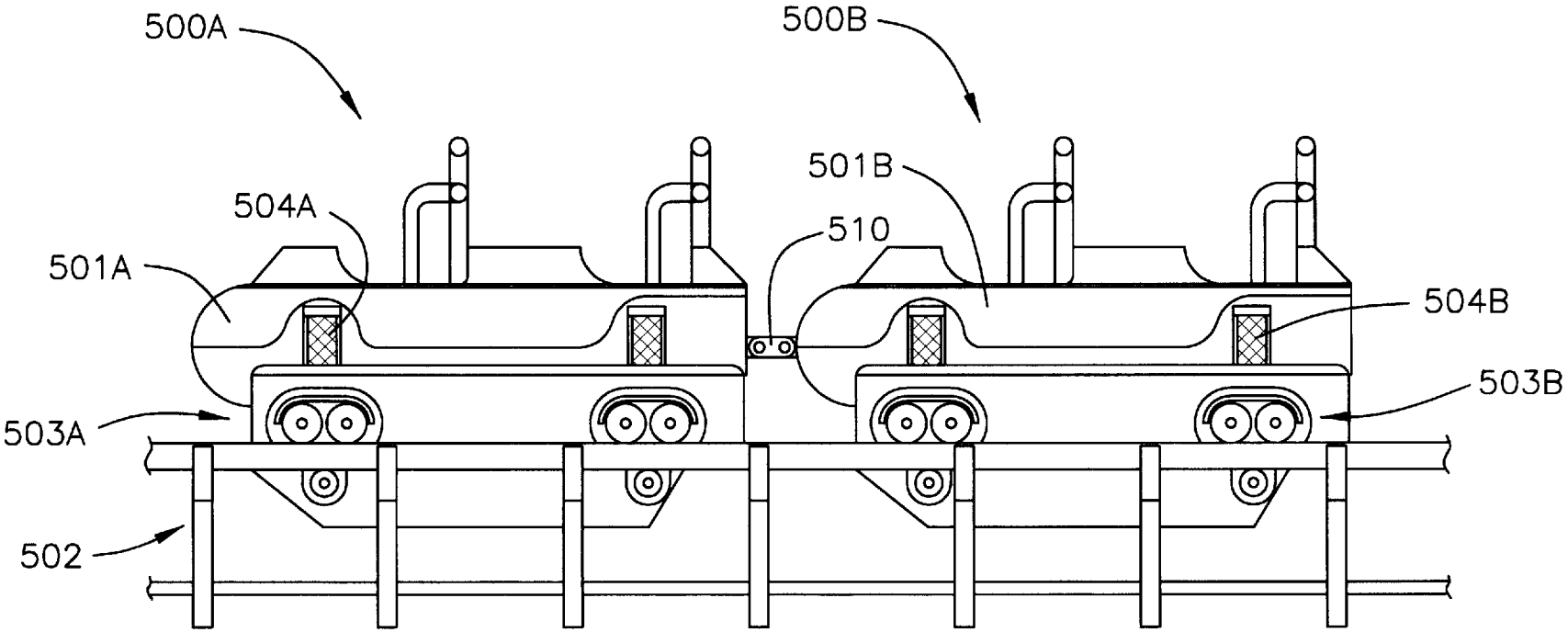
FIG. 5 illustrates a side view of an example train of vehicles.

As an example ride system configuration, FIG. 5 illustrates an example of a train type configuration. As shown, a plurality of vehicles 500A, 500B are connected in series via a connection 510. Each vehicle 500A, 500B has a roll degree of freedom independent of the other vehicle. For example, guest compartment 501A has a roll degree of freedom by virtue of one or more interfaces with chassis 503A, as via one or more radial mounts 504A. Thus, guest compartment 501A can roll about chassis 503A as it travels along the track 502. Likewise, guest compartment 501B has a roll degree of freedom by virtue of one or more interfaces with chassis 503B, as via one or more radial mounts 504A. Thus, guest compartment 501B can roll about chassis 503B as it travels along the track 502.

Figure 6:
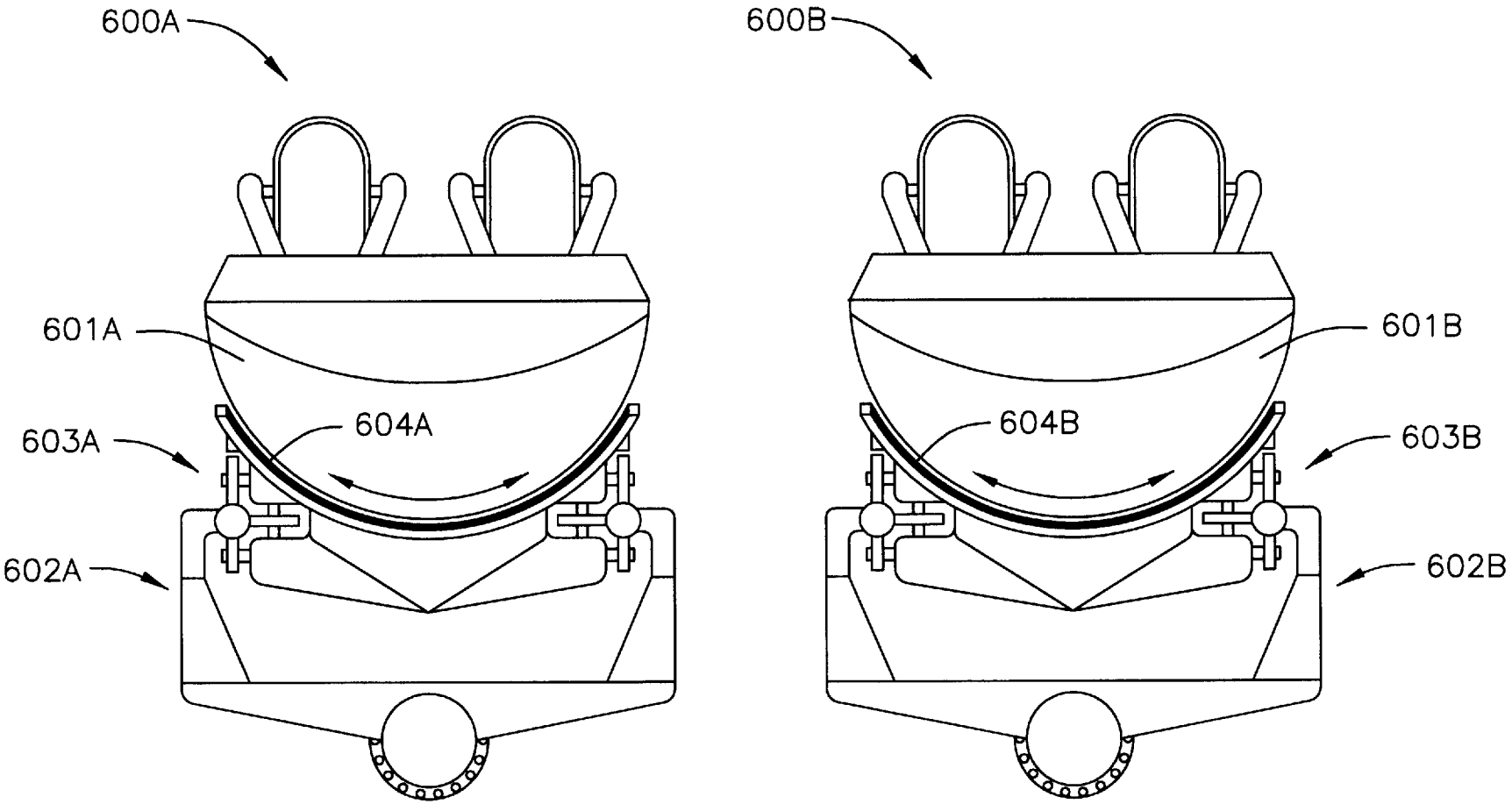
FIG. 6 illustrates a front view of an example racer configuration of vehicles.

As another example ride system configuration, FIG. 6 illustrates an example of a racer type configuration. Vehicles 600A, 600B each ride atop a separate track (602A, 602B, respectively). The vehicles 600A, 600B interface with a chassis (603A, 603B, respectively) via an attachment portion (refer to FIGS. 3-4). Each chassis (603A, 603B, respectively) secures each vehicle 600A, 600B to the track below (602A, 602B, respectively). As described in FIGS. 3-4, the attachment portion interfaces with a radial mount (604A, 604B, respectively) such that each guest compartment (601A, 601B, respectively) has a roll degree of freedom relative to its chassis (603A, 603B, respectively).

In brief recapitulation, embodiments are directed to systems for amusement park rides providing variability of guest experience via a guest compartment configured to ride along a track and have a roll degree of freedom relative to a connection (chassis) with a track. Embodiments provide a guest compartment having a roll degree of freedom by virtue of a radial mount. As described herein, the radial mount can take a variety of forms, including but not limited to one or more mountings positioned at the front and/or rear of each vehicle's guest compartment.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative embodiments have been described herein with reference to the accompanying drawings, it is to be understood that the embodiments are not limited to those precise embodiments, and that various other changes and modifications may be affected therein by one skilled in the art without departing from the scope or spirit of the disclosure.

What is claimed is:

1. A ride vehicle comprising:

a guest compartment having an attachment portion; and a chassis configured to travel along a track, the chassis having a radial mount portion and a portion configured to securely attach to the track;

wherein the attachment portion of the guest compartment and the radial mount portion of the chassis to connect the guest compartment and the chassis such that a roll degree of freedom about an axis that runs parallel to the track is imparted to the guest compartment relative to the chassis.

2. The ride vehicle according to claim 1, further comprising:

a limiting arrangement configured to limit the roll degree of freedom within a predetermined range;

wherein said radial mount portion further comprises a track tube portion of the chassis positioned generally perpendicularly to the track;

wherein said attachment portion further comprises a wheel assembly;

the roll degree of freedom imparted by the wheel assembly of the guest compartment rolling along the track tube portion.

3. The ride vehicle according to claim 1, wherein the chassis further comprises:

a second radial mount portion; and a second attachment configured to connect the guest compartment and the second radial mount portion.

4. The ride vehicle according to claim 3, wherein the attachment is disposed within a rear portion of the guest compartment and the second attachment is disposed within a front portion of the guest compartment.

5. The ride vehicle according to claim 1, wherein the guest compartment further comprises one or more additional components configured to control rolling of the guest compartment.

6. The ride vehicle according to claim 5, wherein the one or more additional components are configured to dampen rolling of the guest compartment.

7. The ride vehicle according to claim 6, wherein the one or more additional components comprises one or more hydraulic cylinders.

8. The ride vehicle according to claim 5, wherein the one or more additional components are configured to actuate rolling of the guest compartment.

9. The ride vehicle according to claim 8, wherein the one or more additional components comprises one or more electric motor assemblies.

10. A ride system comprising:

a plurality of vehicles;

wherein one or more of the plurality of vehicles comprises:

a guest compartment having an attachment portion; and a chassis configured to travel along a track, the chassis having a radial mount portion and a portion configured to securely attach to the track;

wherein the attachment portion of the guest compartment and the radial mount portion of the chassis to connect the guest compartment and the chassis such that a roll degree of freedom about an axis that runs parallel to the track is imparted to the guest compartment relative to the chassis.

11. The ride system according to claim 10, further comprising a limiting arrangement configured to limit the roll degree of freedom within a predetermined range.

12. The ride system according to claim 10, wherein the chassis further comprises:

a second radial mount portion; and a second attachment configured to connect the guest compartment and the second radial mount portion.

13. The ride system according to claim 12, wherein the attachment is disposed within a rear portion of the guest compartment and the second attachment is disposed within a front portion of the guest compartment.

14. The ride system according to claim 10, wherein the guest compartment further comprises one or more additional components configured to control rolling of the guest compartment.

15. The ride system according to claim 14, wherein the one or more additional components are configured to dampen rolling of the guest compartment.

16. The ride system according to claim 14, wherein the one or more additional components are configured to actuate rolling of the guest compartment.

17. A ride system comprising:

a plurality of vehicles; and a plurality of tracks;

wherein one or more of the plurality of vehicles are configured to ride on separate tracks of the plurality of tracks;

wherein one or more of the plurality of vehicles comprises:

a guest compartment having an attachment portion; and a chassis configured to travel along a track of the plurality of tracks, the chassis having a radial mount portion and a portion configured to securely attach to the track of the plurality of tracks;

wherein the attachment portion of the guest compartment and the radial mount portion of the chassis connect the guest compartment and the chassis such that a roll degree of freedom about an axis that runs parallel to the track is imparted to the guest compartment relative to the chassis.

18. The ride system according to claim 17, further comprising one or more additional components configured to control rolling of the guest compartment.

19. The ride system according to claim 18, wherein the one or more additional components are configured to dampen rolling of the guest compartment.

20. The ride system according to claim 18, wherein the one or more additional components are configured to actuate rolling of the guest compartment.

* * * * *